US005647451A

United States Patent [19]

Reichel

[11] Patent Number: 5,647,451

[45] Date of Patent: Jul. 15, 1997

[54] PORTABLE ROOF GUARD RAIL SUPPORT DEVICE

[76] Inventor: Mark W. Reichel, 2320 Larch La. North, Plymouth, Minn. 55441

[21] Appl. No.: 552,827

[22] Filed: Nov. 3, 1995

[51] Int. Cl.[6] ..... E04H 17/14

[52] U.S. Cl. ..... 182/45; 182/113; 256/DIG. 6

[58] Field of Search ..... 182/45, 113; 248/237; 256/1, DIG. 2, DIG. 6

[56] References Cited

U.S. PATENT DOCUMENTS

| | | | |
|---|---|---|---|
| 1,495,868 | 5/1924 | Nielsen | 248/237 |
| 1,864,457 | 6/1932 | Nelson | 248/237 |
| 2,329,415 | 2/1943 | Osborne | 304/20 |
| 3,867,997 | 2/1975 | Hyslop, Jr. | 182/113 |
| 3,901,481 | 8/1975 | Probst | 248/237 X |
| 4,676,341 | 6/1987 | Shaffstall | 182/45 |
| 4,909,483 | 3/1990 | Van Herpen | 182/113 X |
| 4,972,922 | 11/1990 | Levine | 182/45 |
| 4,979,725 | 12/1990 | Hutchings, II et al. | 256/DIG. 6 X |
| 5,377,958 | 1/1995 | Palmer | 256/59 |
| 5,379,859 | 1/1995 | Pigman | 182/45 |
| 5,431,372 | 7/1995 | Kostelecky | 256/64 |

*Primary Examiner*—Alvin C. Chin-Shue

*Attorney, Agent, or Firm*—Palmatier, Sjoquist, Helget & Voigt, P.A.

[57] ABSTRACT

A portable roof guard rail support device adapted for fastening directly to a pitched roof and adapted for adjustment to the pitch of the roof for protecting workers from falling off the roof comprises a roof attachment plate for attaching directly to the roof, a support beam pivotally connected to the roof attachment plate, an angle adjustment brace removably connected to the roof attachment plate and rotatably connected to the support beam for varying the angle at which the support beam is connected to the roof attachment plate, a plurality of cross bar channels through the support beam for attaching removable cross bars, and a channel within the support beam for storing the angle adjustment brace for transportation.

16 Claims, 2 Drawing Sheets

PORTABLE ROOF GUARD RAIL SUPPORT DEVICE

BACKGROUND OF THE INVENTION

A recurring safety problem has been workers falling from the roofs of buildings which are under construction, such as roofing, or upon which other work is being performed. Often, these accidents occur when the workers are moving about and carrying materials back and forth, and it sometimes happens that a worker will simply back over the edge of the roof while not looking.

The magnitude of this hazard has drawn the attention of several regulatory bodies, including the Occupational Safety and Health Administration (OSHA) in the United States, and the Department of Occupational Safety and Health in Canada. As a result, some form of barrier is now required around roof edges where people will be working, and various attempts have been made to comply with this.

Current OSHA requirements call for the upper edge of such safety guard barriers to be positioned about 42 inches above the edge of the roof, and OSHA standards call for this barrier to be able to support a 200 pound static load in either outward or inward directions.

Attempts have been made in the past to solve this problem, but such past devices have either not been adjustable to the pitch of the roof, use a pitch adjustment which presents a potential point of failure, are difficult to set up and remove, or are overly complex.

There is a need for a portable roof guard rail support which meets OSHA requirements, is easy to set up and remove, is adjustable to the pitch of the roof, is solidly constructed with few points of failure, and is collapsible so as to be easily transportable between job sites.

SUMMARY OF THE INVENTION

A portable roof guard rail support device adapted for fastening directly to a pitched roof and adapted for adjustment to the pitch of the roof for protecting workers from falling off the roof comprises a roof attachment plate for attaching directly to the roof, a support beam pivotally connected to the roof attachment plate, an angle adjustment brace removably connected to the roof attachment plate and rotatably connected to the support beam for varying the angle at which the support beam is connected to the roof attachment plate, a plurality of cross bar or rail channels through the support beam for attaching removable cross bars or rails, and a channel within the support beam for storing the angle adjustment brace for transportation.

A principal object and advantage of the present invention is that it is attachable directly to a roof without the need for a ladder or other external support structure.

Another principal object and advantage of the present invention is that it is adjustable to the pitch of the roof so that the roof guard rail support device may present an approximately vertical safety guard to prevent workers from falling off the roof.

Another object and advantage of the present invention is that the angle adjustment brace is of solid, one-piece construction and does not present a potential point of failure under impact.

Another object and advantage of the present invention is that it is collapsible for transportation, with the angle adjustment brace being stored within the support beam.

Another object and advantage of the present invention is that the support beam includes a plurality of pre-formed cross-bar channels for inserting cross-bars or rails, for example 2×4 lumber.

Another object and advantage of the present invention is that it is simple to set up and remove and is of simple construction.

DETAILED DESCRIPTION OF THE PREFERRED EMBODIMENTS

Figure 1:
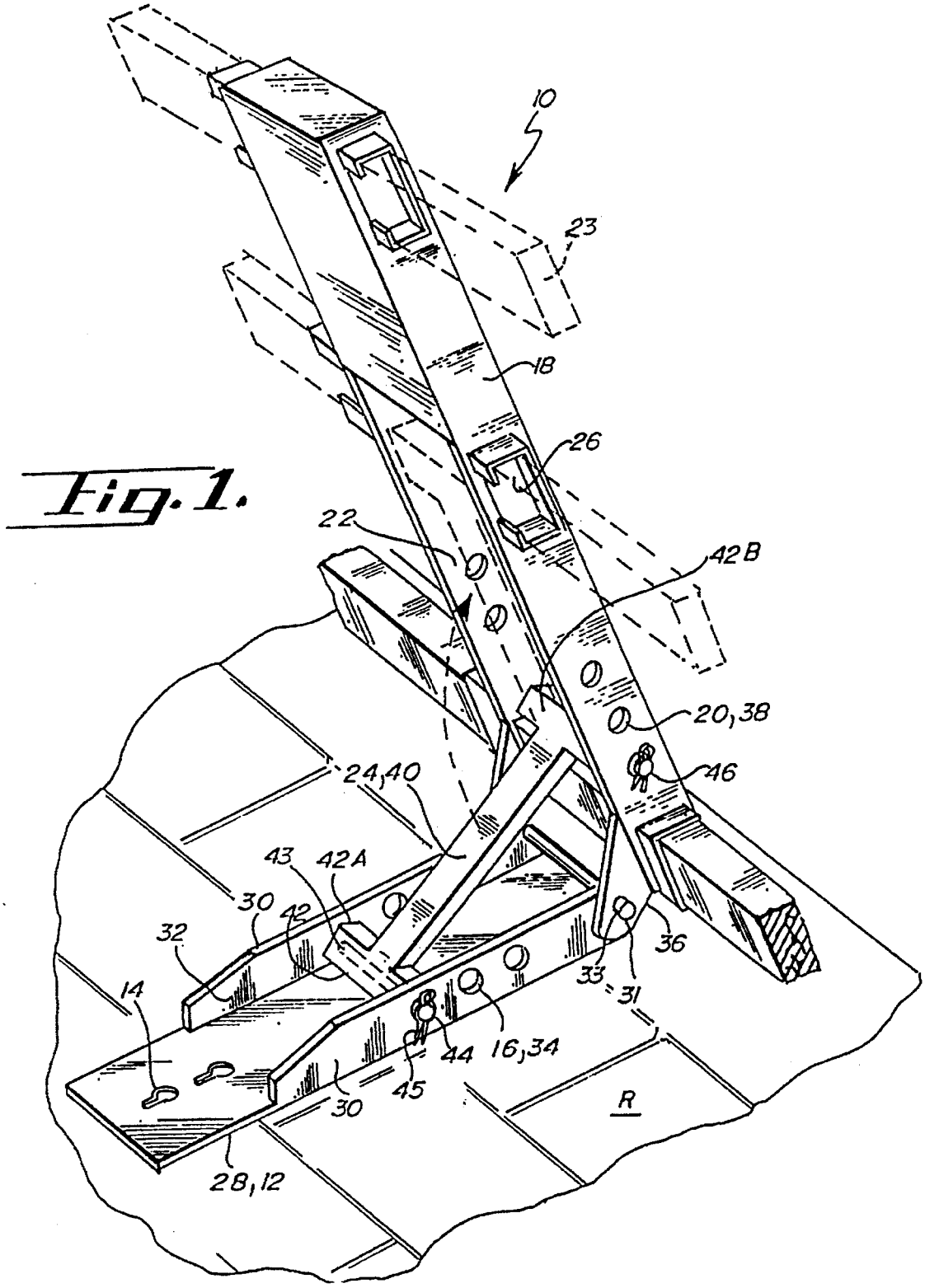
FIG. 1 is a perspective view of the present invention.
Figure 2:
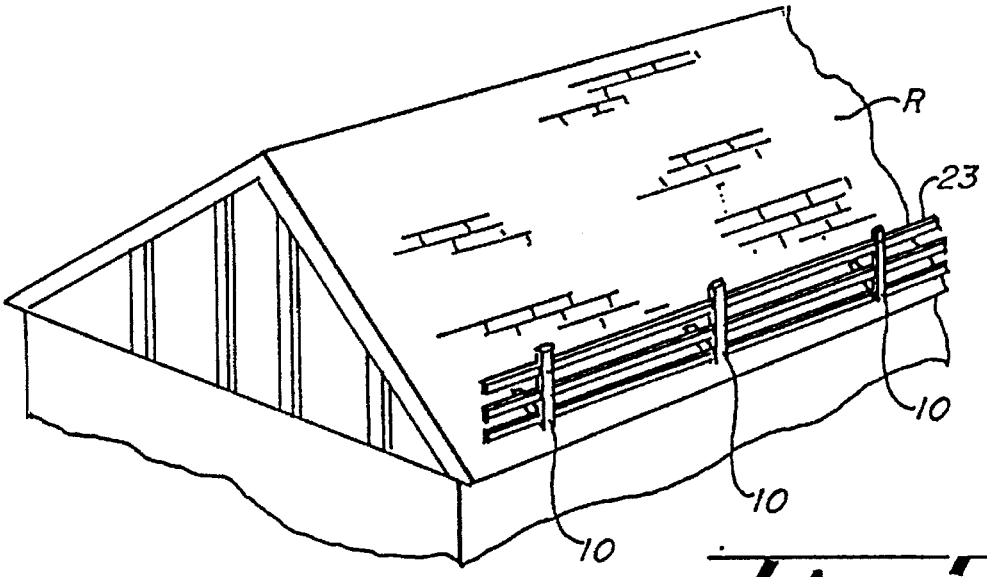
FIG. 2 is a perspective view of the present invention set up on a roof.
Figure 3:
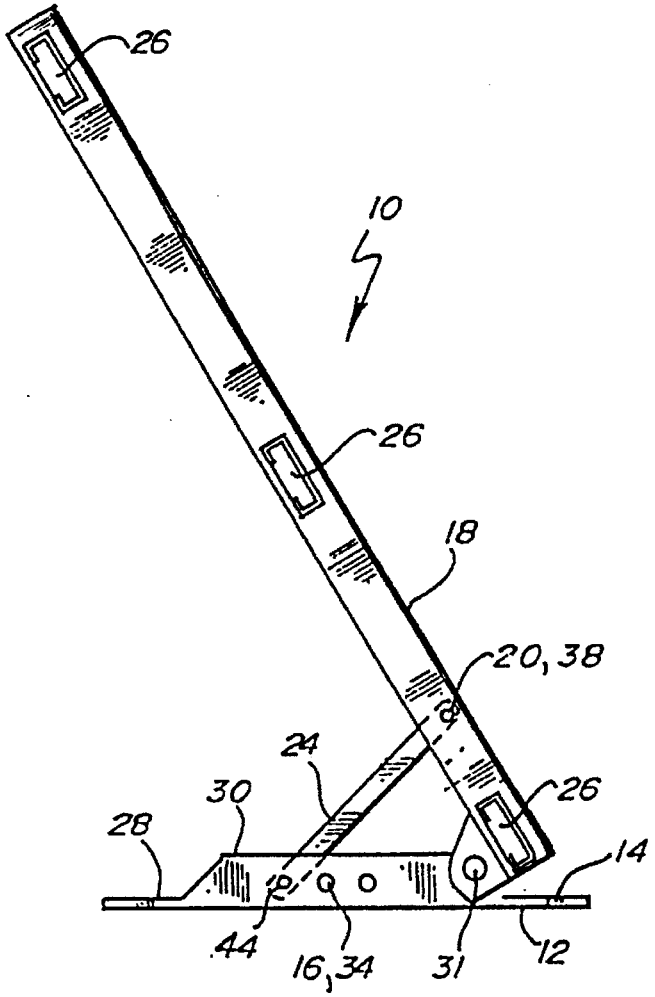
FIG. 3 is a side elevational view of the present invention.

The novel, portable roof guard rail support device of the present invention is shown in the Figures as reference numeral 10.

As can be seen, the portable roof guard rail support device 10 consists of a roof attachment plate 12 for directly attaching the roof guard rail support device 10 to the roof R. The roof attachment plate 12 attaches to the roof R suitably by nails or screws partially passing through holes 14. The roof attachment plate 12 has a first adjustment point 16.

The portable roof guard rail support device 10 also includes a support beam 18 pivotally connected to the roof attachment plate 12. The support beam 18 has a second adjustment point 20. The support beam 18 also has a support beam channel 22 therein, the purpose of which will be discussed below.

An angle adjustment brace 24 is removably connected to the roof attachment plate 12 at the first adjustment point 16 and rotatably connected to the support beam 18 at the second adjustment point 20. The angle adjustment brace 24 allows the angle at which the support beam 18 is pivotally connected to the roof attachment plate 12 to be varied according to the pitch of the roof R, thereby allowing the support beam 18 to be approximately vertical with respect to the ground, if desired. The angle adjustment brace 24 may be removed from the roof attachment plate 12 and rotated for storage within the support beam channel 22 as shown in phantom.

A plurality of cross bar channels 26 are formed through the support beam 18 normal to the support beam channel 22, for receiving removable cross bars or rails 23.

Preferably, the roof attachment plate 12 further comprises a base plate 28 directly attached to the roof R, and a pair of vertical legs walls or flanges 30 attached to the base plate 28 and extending normal to the plane of the base plate 28 and forming with the base plate 28 a roof attachment plate channel 32. Preferably, the first adjustment point 16 is comprised of one of the first adjustment apertures or openings 34 through the vertical legs 30.

The support beam 18 preferably comprises a first end 36 pivoted to the base plate 28 by a removable pivot pin 31 and pivot pin aperture or opening 33. The second adjustment point 20 preferably comprises one of the second adjustment apertures or openings 38 through the support beam 18. One or more second adjustment openings 38 may exist.

Preferably, the angle adjustment brace 24 further comprises a solid longitudinal member 40 and two cross members 42 normal to the longitudinal member 40. The cross members 42 have hollow cores 43 through them for receiving pins 44. One of the cross members 42A is slidingly engaged in the roof attachment plate channel 32 and aligns with the first adjustment opening 34 and is secured thereat by the first adjustment pin 44. The other solid cross member 42B is rotatably engaged in the support beam channel 22 by a second adjustment pin 46 and second adjustment opening 38.

The cross bar channels 26 preferably slidingly engage removable cross bars or rails 23. Preferably, the cross bars 23 are 2×4 lumber.

In operation, the portable roof guard rail support device 10 is placed on the roof R with the base plate 28 directly contacting the pitched roof R. Nails, screws or spikes are driven through holes 14 into the roof R to securely hold the portable roof guard rail 10 in place on the roof.

Next, the support beam 18 is rotated about the pivot pin 31 and unfolded from its position against the base plate 28 where it was placed for transportation and storage.

The support beam 18 is thus rotated until the desired angle of the support beam 18 relative to the base plate 28 is achieved. Usually, it will be desirable that the support beam 18 will be vertical with respect to the ground.

Next, the angle attachment brace 24 is rotated about the second adjustment pin 46 and rotated out of its stored position within the support beam channel 22. The cross member 42A of the angle adjustment brace 24 opposite the second adjustment pin 46 is slid into the attachment plate channel 32 and along the attachment plate channel 32 until the cross member 42A lines up with one of the first adjustment openings 34. The first adjustment openings 34 are pre-drilled at positions that will achieve vertical orientation of the support beam 18 on roofs with various standard pitches.

Then, the first adjustment pin 44 is inserted through the hollow core 43 in the cross member 42A and through the first adjustment opening 34. A cotter pin 45 may then be inserted through the first adjustment pin 44 to hold the first adjustment pin 44 in place.

Finally, the cross bars 23 are slid through the cross bar channels 26 to form railings.

The portable roof guard rail support device 10 may be easily removed from the roof as follows. First, the cross bars 23 are slid out of the cross bar channels 26.

Next, the cotter pin 45 is removed from the first adjustment pin 44, the first adjustment pin 44 is removed from the first adjustment opening 34, and the angle adjustment brace is removed from the attachment plate channel 32 and rotated about the second adjustment pin 46 for storage in the support beam channel as shown in phantom in the Figures.

Finally, the nails or spikes through the holes 14 are pulled out of the roof R and the portable roof guard rail support device 10 is removed from the roof R.

It will be seen that the portable roof guard rail support device 10 is easy to install and remove from the roof. The roof attachment plate 28 allows the portable roof guard rail support device 10 to be attached directly to the roof R without the need for a ladder or other external support structure.

The portable roof guard rail support device 10 is adjustable to the pitch of the roof R so as to present an approximately vertical safety rail to prevent workers from falling off the roof.

The angle adjustment brace 24, which allows the portable roof guard rail support device 10 to be adjusted to the pitch of the roof, is of solid, one-piece construction unlike previous pitch adjustment mechanisms and therefore does not present a potential point of failure under impact.

The portable roof guard rail support device 10 has several pre-formed cross bar channels 26 which accept cross bars such as 2×4 lumber.

The portable roof guard rail support device 10 is collapsible for transportation, with the angle adjustment brace 24 being stored within the support beam channel 22.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A portable, collapsible roof guard rail support device adapted for fastening directly to a pitched roof and adapted for adjustment to the pitch of the roof for protecting workers from falling off the roof, the device comprising:

a roof attachment plate for attaching said roof guard rail support device directly to the roof, said roof attachment plate having a first adjustment point, a support beam pivotally connected to said roof attachment plate, said support beam having a support beam channel lengthwise therein and a second adjustment point, an angle adjustment brace removably connected to said roof attachment plate at said first adjustment point and rotatably connected to said support beam at said second adjustment point, for varying the angle at which said support beam is pivotally connected to said roof attachment plate, and a plurality of cross bar channels through said support beam normal to said support beam channel, said angle adjustment brace being storable within said support beam channel for transportation.

2. The portable, collapsible roof guard rail support device of claim 1, wherein said roof attachment plate further comprises a base plate directly attached to the roof, and a pair of vertical legs attached to said base plate and extending normal to the plane of said base plate and forming with said base plate a roof attachment plate channel, said first adjustment point being a plurality of first adjustment openings through said vertical legs.

3. The portable, collapsible roof guard rail support device of claim 2, wherein said support beam further comprises a first end pivoted to said base plate and said second adjustment point being a second adjustment opening through said support beam.

4. The portable, collapsible roof guard rail support device of claim 3, wherein said angle adjustment brace further comprises a solid longitudinal member and two cross members with hollow cores therethrough normal to said solid longitudinal member, one of said cross members being slidingly engaged in said roof attachment plate channel and connecting to said first adjustment openings by a first adjustment pin.

5. The portable, collapsible roof guard rail support device of claim 4, wherein the other of said cross members is rotatably engaged in said support beam channel by a second adjustment pin connecting to said second adjustment opening.

6. The portable, collapsible roof guard rail support device of claim 1, wherein said cross bar channels slidingly engage removable cross bars.

7. The portable, collapsible roof guard rail support device of claim 6, wherein said removable cross bars are 2×4 lumber.

8. A portable, collapsible roof guard rail support device adapted for fastening directly to a pitched roof and adapted for adjustment to the pitch of the roof for protecting workers from falling off the roof, comprising:

a roof attachment plate for attaching said roof guard rail support device directly to the roof, said roof attachment plate having a roof attachment plate channel lengthwise therein and a first adjustment point within said roof attachment plate channel, a support beam pivotally connected to said roof attachment plate, said support beam having a support beam channel lengthwise therein and a second adjustment point within said support beam channel, a solid, one-piece angle adjustment brace removably connected to said roof attachment plate at said first adjustment point within said roof attachment plate channel and rotatably connected to said support beam at said second adjustment point within said support beam channel, for varying the angle at which said support beam is pivotally connected to said roof attachment plate, and a plurality of cross bar channels through said support beam normal to said support beam channel, said angle adjustment brace being storable within said support beam channel for transportation.

9. The portable, collapsible roof guard rail support device of claim 8, wherein said roof attachment plate further comprises a base plate directly attached to the roof, and a pair of vertical legs attached to said base plate and extending normal to the plane of said base plate and forming said roof attachment plate channel with said base plate, said first adjustment point being a plurality of first adjustment openings through said vertical legs.

10. The portable, collapsible roof guard rail support device of claim 9, wherein said support beam further comprises a first end pivoted to said base plate by a removable pivot pin and pivot opening and said second adjustment point being a second adjustment opening through said support beam.

11. The portable, collapsible roof guard rail support device of claim 10, wherein said angle adjustment brace further comprises a solid longitudinal member and two cross members with hollow cores therethrough normal to said solid longitudinal member, one of said cross members slidingly engaged in said roof attachment plate channel and connecting to said first adjustment opening by a first adjustment pin.

12. The portable, collapsible roof guard rail support device of claim 11, wherein the other of said cross members is rotatably engaged in said support beam channel by a second adjustment pin connecting to said second adjustment opening.

13. The portable, collapsible roof guard rail support device of claim 8, wherein said cross bar channels slidingly engage removable cross bars.

14. The portable, collapsible roof guard rail support device of claim 13, wherein the removable cross bars are 2×4 lumber.

15. A portable, collapsible roof guard rail support device adapted for fastening directly to a pitched roof and adapted for adjustment to the pitch of the roof for protecting workers from falling off the roof, comprising:

an elongate base plate having holes therein for fastening said base plate directly to the roof, a pair of vertical legs attached to said base plate and extending normal to the plane of said base plate and forming a roof attachment plate channel lengthwise with said base plate, said vertical legs having a plurality of first adjustment openings therethrough and a pivot opening therethrough, an elongate support beam having a first end pivoted to said base plate through a pivot pin intersecting said first end and said pivot opening, and said support beam having a second adjustment opening therethrough, and said support beam having a support beam channel lengthwise therein, a solid, one-piece angle adjustment brace connecting to said base plate and to said support beam and adapted for varying the angle at which said support beam is pivoted to said base plate, said angle adjustment brace being connected to said base plate by attachment to said first adjustment openings by a first adjustment pin and said angle adjustment brace being removably connected to said support beam by attachment to said second adjustment opening by a second adjustment pin, said angle adjustment brace further comprising a solid longitudinal member and two cross members with hollow cores therethrough normal to said solid longitudinal member, one of said cross members slidingly engaged in said roof attachment plate channel, and a plurality of cross bar channels in said support beam normal to said second support beam channel, said cross bar channels adapted to slidingly engage a plurality of removable cross bars, said angle adjustment brace being rotatable about said second adjustment pin for storage in said support beam channel after being disconnected from said base plate.

16. The portable, collapsible roof guard rail support device of claim 15, wherein said cross bars are 2×4 lumber.

* * * * *